US006703558B2

(12) United States Patent
Uang

(10) Patent No.: US 6,703,558 B2
(45) Date of Patent: Mar. 9, 2004

(54) COIL WIRE FOR SUPPRESSING ELECTROMAGNETIC INTERFERENCE

(75) Inventor: Muh-Jin Uang, Taipei Hsien (TW)

(73) Assignee: Acer Incorporated (TW)

( * ) Notice: Subject to any disclaimer, the term of this patent is extended or adjusted under 35 U.S.C. 154(b) by 0 days.

(21) Appl. No.: 09/972,852

(22) Filed: Oct. 10, 2001

(65) Prior Publication Data

US 2002/0043387 A1 Apr. 18, 2002

(30) Foreign Application Priority Data

Oct. 13, 2000 (CN) ..... 89217705 U

(51) Int. Cl.[7] ..... H01B 7/34
(52) U.S. Cl. ..... 174/36; 333/12
(58) Field of Search ..... 174/102 R, 103, 174/106 R, 108, 36; 333/12, 181; 340/310

(56) References Cited

U.S. PATENT DOCUMENTS 3,836,415 A * 9/1974 Hilderbrandt ..... 156/181
4,746,766 A * 5/1988 Soulard ..... 174/36
4,934,048 A * 6/1990 McElheny et al. ..... 29/856
4,941,845 A * 7/1990 Eppley et al. ..... 439/505
5,113,159 A * 5/1992 Adriaenssens et al. ..... 333/12
5,504,540 A * 4/1996 Shatas ..... 348/844
5,536,978 A * 7/1996 Cooper et al. ..... 307/89
5,606,734 A * 2/1997 Bahu ..... 455/303
5,812,577 A * 9/1998 Dawson et al. ..... 372/46
5,852,613 A * 12/1998 Nagatani et al. ..... 370/546
6,114,632 A * 9/2000 Planas et al. ..... 174/117 R

* cited by examiner

*Primary Examiner*—William H. Mayo, III
(74) *Attorney, Agent, or Firm*—Michael D. Bednarek; Shaw Pittman LLP

(57) ABSTRACT

A connecting cable for bridging a computer host and a peripheral device including a signal line for data transmission and a power cable. A portion of the power cable is wrapped around the signal line to form the coil wire. Therefore, rapid noise variation of a braided wire on the signal line can pass the coil wire to induce a rapid change of magnetic flux and then further to generate a reverse induced current for eliminating the noise intensity on the power cable.

18 Claims, 6 Drawing Sheets

COIL WIRE FOR SUPPRESSING ELECTROMAGNETIC INTERFERENCE

BACKGROUND OF THE INVENTION (1) Field of the Invention

The invention relates to a coil wire for suppressing electromagnetic interference, and more particularly to a wiring design which can protect a cable from electromagnetic interference (EMI).

(2) Description of the Prior Art

Recently, innovation upon the communication technology has been expediting the development of computer peripherals such as monitors and the like displays. For a display, no matter it is a thin film transistor liquid crystal display (TFT-LCD), a plasma display panel (PDP) or a liquid crystal display (LCD) of other types, rapid data transmission through cabling is the trend to achieve high-quality visions. However, under such an application, electromagnetic interference (EMI) has become a more and more severe problem. For the low-frequency electromagnetic interference with frequencies lower than 500 MHz, it is well known to suppress the electromagnetic interference of a cable by introducing a ferrite core. Yet, such a design can still fail to waive the cable from high-frequency noises. It is noted that the electromagnetic interference can not only happen to the cable for connecting the liquid crystal display and the computer host. Similar problems also happen to power cables and other cable lines that connect computer peripherals to the computer host. For usage of the rapid data transmissions the ferrite core is usually used to wrap the power cable or the cable line at one end to reduce the effect of the electromagnetic noises.

Currently, for cable lines in the market, especially for the LCD cables, most of the cable lines utilize the ferrite cores to enhance their resistance against the electromagnetic interference. Nevertheless, the performance of the ferrite core on suppressing the electromagnetic interference is mainly dependent upon its material property, inner diameter, outer diameter, length and so on. Generally speaking, the ferrite core can be useful to suppress a noise with a frequency lower than 500 MHz. On the other hand, for a noise with a frequency larger than 500 MHz, the ferrite core may fail to suppress the electromagnetic interference. Further, the ferrite core may strengthen its resistance against the electromagnetic interference by increasing its inner diameter or its length. Yet, upon such a change, the trade-off would be the appearance, the volume, the weight and the cost of the cable, while the strengthening of the resistance might still be limited. Actually, in the art, no complete resolution can be provided to suppress the electromagnetic interference.

On the other hand, as a standpoint of computer manufacturers, it is much economic and good-looking to construct most of related power cables onto a mother board of a computer. For example, if a 12V DC source for an LCD monitor of a personal computer (PC) can be constructed directly onto a mother board of the computer, additional external power adapter is then no more required so that more convenience and a cost-down can be provided to the computer system. But for the dark side, the electromagnetic interference may be easily arisen by locating the 12V DC source such close to another source for a decoder IC of the LCD monitor.

In an ordinary design of an LCD PC, an LCD cable for the monitor is mainly divided into a part for data transmission and another part for forming a 12V DC power cable. The part for data transmission is usually shielded by a braided wire. The part for forming the 12V DC power cable is usually grounded through a thin wire. As shown in FIG. 1, the connecting cable 1 in the art mainly includes two terminal connectors 7 and 8 for bridging a peripheral device (an LCD panel for example) and the computer host. The connecting cable 1 comprises a middle splitter 3 for bifurcating the connecting cable 1 into a power cable 4 and a signal line 5. The power cable 4, used to provide electricity to the peripheral device, has a free end formed as a DC plug 9. The signal line 5 is the part of the connecting cable 1 that is used for data transmission. As shown, one end of the signal line 5 is the terminal connector 8 for engaging with the peripheral device, and the other end thereof is connected with the power cable 4 at the splitter 3. The terminal connector 7 of the connecting cable 1 opposing to the splitter 3 is prepared to engage with the computer host. In this design, the signal line 5 is a high-frequency signal line wrapped by a braided wire 6 to protect the electromagnetic interference.

To avoid the electromagnetic interference, the conventional connecting cable 1 as shown in FIG. 1 comprises a ferrite core 2 as an exterior shield for protecting the connecting cable 1 from the electromagnetic interference. However, several disadvantages of using the ferrite core 2 can be seen. As mentioned, upon using the ferrite core 2, many factors as the appearance, the volume, the weight and the cost can be at the weak side. Such disadvantages can be easily observed from FIG. 2, a perspective view of part of the connecting cable 1 of FIG. 1.

Hence, it is the motivation of the present invention how a connecting cable can be designed, by which the connecting cable can protect the power cable and the signal line from the electromagnetic interference, cost thereof can be kept within a reasonable range, and wiring thereof can provide a better appearance.

SUMMARY OF THE INVENTION

To overcome the aforesaid disadvantages of the prior art, the present invention firstly analyzes the product in FIG. 1 as a base line for further improvement. After carefully analyzing, it is found that both the braided wire for shielding the rapid data line (i.e., the high-frequency signal line) and the power cable can be interfered simultaneously by the high-frequency noise so as to render the problem of electromagnetic interference. In particular, the power cable is most interfered, for the connected ground wire of the power cable is usually too thin to provide adequate resistance for shielding. Fortunately, the power cable extends close to the braided wire after it leaves the LCD panel; so that a ground loop can be introduced to compensate the problem caused by the thin ground wire. However, in the practice, for plugging the power cable at a position close to the computer host end, the power cable needs to be arranged away from the braided signal line. Under such an arrangement, the ground wire is removed and the electromagnetic interference problem arises.

Therefore, the present invention introduces a novel structure in which the power cable is led to wrap the signal line with the braided wire. By providing rapid noise variation of the braided wire to go through the coil formed by the wrapping power line, a rapid change of magnetic flux can be induced to generate a reverse induced current for further eliminating the noise intensity on the power cable. Thereby, the electromagnetic interference problem can be reduced to a minimum, even if the power cable is away from the braided wire.

Preferably, in the aforesaid coil wiring of the present invention, a splitter can be included to fix the coil onto the signal line at the portion where the power cable wraps the signal line.

Preferably, in the aforesaid coil wiring of the present invention, a conductive cloth can be included to adhere the uncoiled power cable onto the signal line.

Preferably, the signal line with the braided wire can be a high-frequency signal line, and the power cable can be a DC power cable.

Preferably, the performance of reducing the electromagnetic interference on the connecting cable by providing the coil wire of the power cable is dependent substantially upon the coil number of the wiring. Also, by provided with adequate coil number of the wiring to the power cable, the high-frequency noise with the frequency higher than 500 MHz can be effectively suppressed.

Preferably, in the coil wiring of the present invention, a pattern of regular wiring can be introduced to wrap the power cable around the line.

All these objects are achieved by the coil wire for suppressing electromagnetic interference described below.

BRIEF DESCRIPTION OF THE DRAWINGS

The present invention will now be specified with reference to its preferred embodiment illustrated in the drawings, in which.

DESCRIPTION OF THE PREFERRED EMBODIMENT

The invention disclosed herein is directed to a coil wire for suppressing electromagnetic interference. In the following description, numerous details are set forth in order to provide a thorough understanding of the present invention. It will be appreciated by one skilled in the art that variations of these specific details are possible while still achieving the results of the present invention. In other instance, well-known components are not described in detail in order not to unnecessarily obscure the present invention.

The present invention, aiming at overcoming aforesaid disadvantages of the conventional cables, mainly applies the Faraday's Law to adopt variation of magnetic passing a flux spiral tube forming by the wiring coil to generate a reverse induced current for further suppressing electromagnetic interference upon a connecting cable; in particular, for suppressing noise interference upon a power cable of an LCD cable. The performance of suppressing electromagnetic interference in accordance with the present invention is dependent upon the coil number of the coil wire. Therefore, the present invention not only provides improvement over the prior art of inserting a ferrite core, in which the present invention can suppress the high-frequency noise interference, but also can keep the cost down and provide better appearance. By providing the present invention, the disadvantages of the cable of FIG. 1 can thus be overcome.

Figure 3:
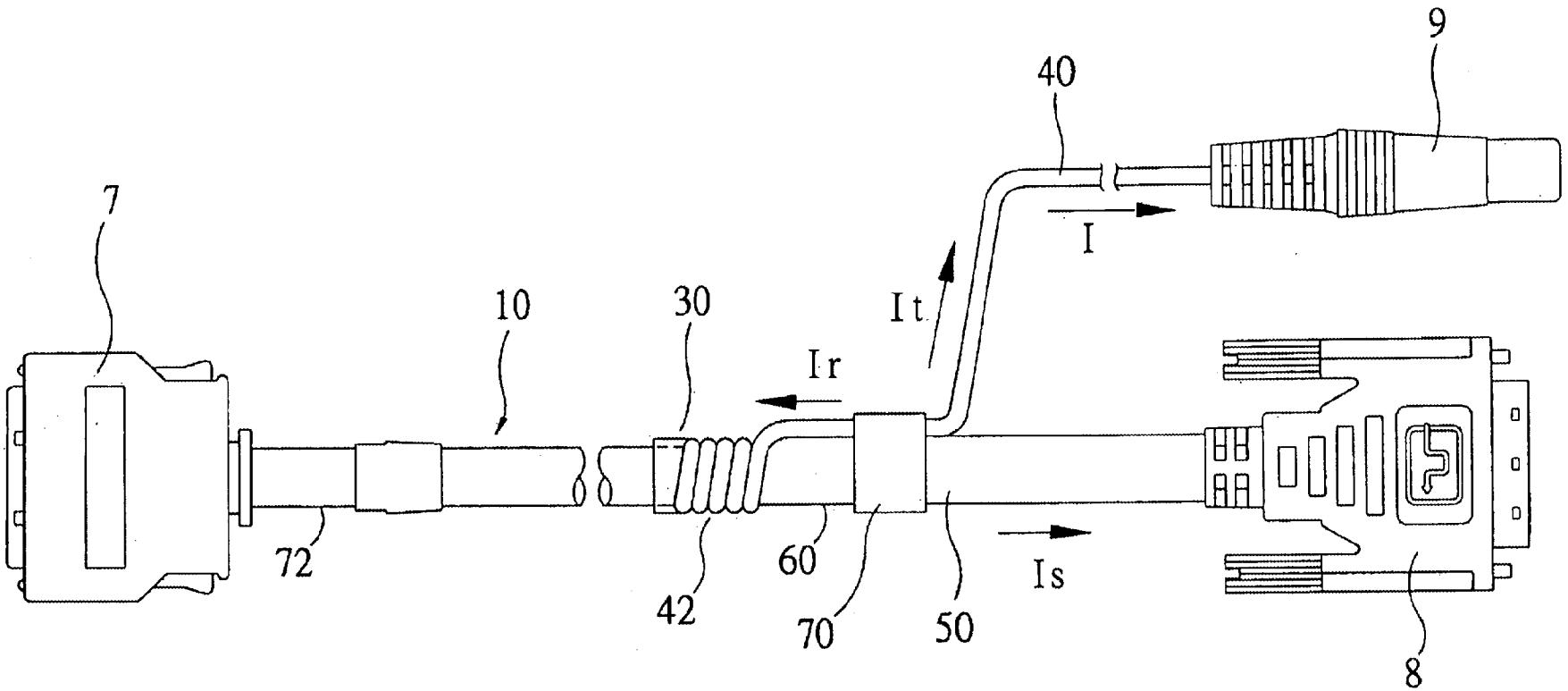
FIG. 3 is a schematic view of a preferred embodiment of the connecting cable in accordance with the present invention.

Referring now to FIG. 3, a preferred embodiment of the connecting cable is shown schematically. The correcting cable 10 for data transmission has two connectors 7 and 8 at respective ends thereof, in which the connector 7 is used to connect with the computer host and the connector 8 is used to connected with the peripheral device such as an LCD panel. The connecting cable 10 comprises thereof a middle splitter 30 close to the connector 8 for further bifurcating a power cable 40 from the signal line 50. The power cable 40 is used to provide electricity to the peripheral device, and in the preferred embodiment, the electricity came from a DC power source hence the power cable 40 can be a DC power cable.

As shown in FIG. 3, one end of the power cable 40 is formed as the splitter 30 while another end of the power cable 40 is formed as a DC plug 9. The power cable 40 can be wrapped with a thin steel wire so as to form a ground loop. After the bifurcation point of the connecting cable 10 where the splitter 30 locates, the connecting cable 10 extends to form the signal line 50 for data transmission. The signal line 50 as a high-frequency signal line provides one end to engage with the power cable 40 at the splitter 30 and the end is further extended to form the connector 7 that is used to connect with the computer host. The other end of the signal line 50 is formed as the connector 8 for connection with the peripheral device. In addition, the signal line 50 is externally shielded with a braided wire 60 for preventing the noise interference of the electromagnetic interference.

As shown in FIG. 3, a portion of the power cable 40 forms a coil wire 42 wrapping the signal line 50 with the braided wire 60, wherein the power cable 40 is connected to the signal line 50 through the splitter 30 and encircles the signal line 50 in the counterclockwise direction for forming the coil wire 42. The number of the coil wire 42 is from 3 to 8, and in the preferred embodiment, the number of the coil wire 42 is 5. Due to the spiral tube effectiveness achieved by the coil wire 42, when the noise current variation passes the coil wire 42 or the center of the coil wire 42, it induces a rapid change of magnetic flux and then further to relatively generate a reverse induced current for eliminating the noise intensity on the power cable 40 or the signal line 50.

As shown in FIG. 3, is stands for the noise current on the signal line 50, It stands for the noise current on the power cable 40, Ir1 stands for the reverse induced current generated by the change of the magnetic flux of the coil wire 42 based on the power cable 40, Ir2 stands for the reverse induced current generated by the change of the magnetic flux of the coil wire 42 based on the signal line 50, I1 is a final signal current on the signal line 50 and I2 is a final signal current on the power cable 40. The noise currents and the induced currents disclosed in the specification are the transient oscillations so as to represent the transient intensity. When the noise current is generated by the signal line 50 and the power code 40 respectively and pass through the coil wire 42, Ir1 and Ir2 are generated due to the spiral tube effectiveness. Furthermore, the directions of Ir1 and Ir2 are in the opposite directions of I1 and I2. Among the relative function of the signal line 50, I1=Is−Ir1 and Is<Ir1. Among the relative function of the power code 40, I2−It−Ir2 and It<Ir2. Thereby, such a design can be used to suppress the noise on the power cable 40 and the signal line 50. Also, for a portion of the power cable 40 away from the braided wire (i.e. the signal line 50), the electromagnetic interference is still not a serious problem.

In the present invention, the coil wire 42 of the power cable 40 is fixed to the signal line 50 by the splitter 30. Also, a conductive cloth 72 is included to cover a portion of the power cable 40 to the signal line 50 after coil wiring. As shown, another fixing annulus 70 can be used between the connecting cable 10 and the connector 7 for ensuring the coil wiring 42 connection in between.

Figure 1:
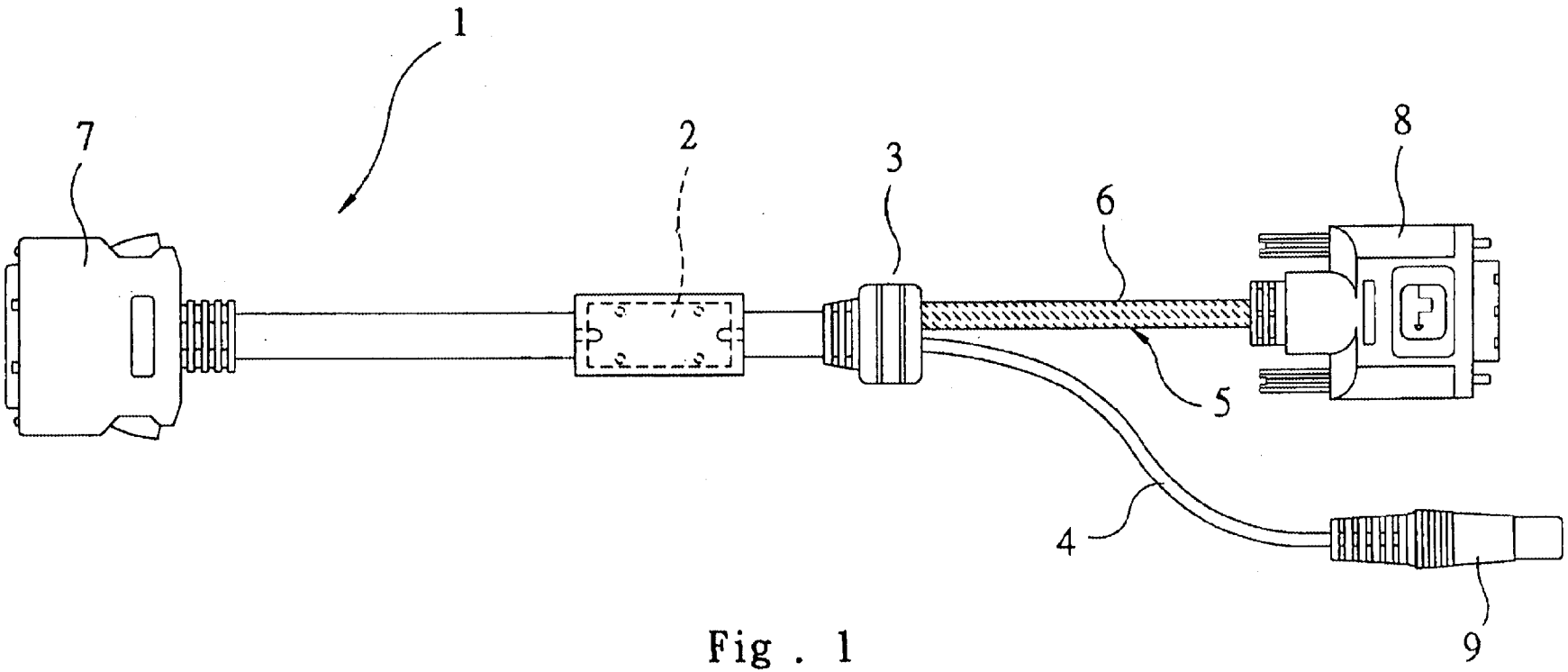
FIG. 1 is a schematic view of a conventional connecting cable.
Figure 2:
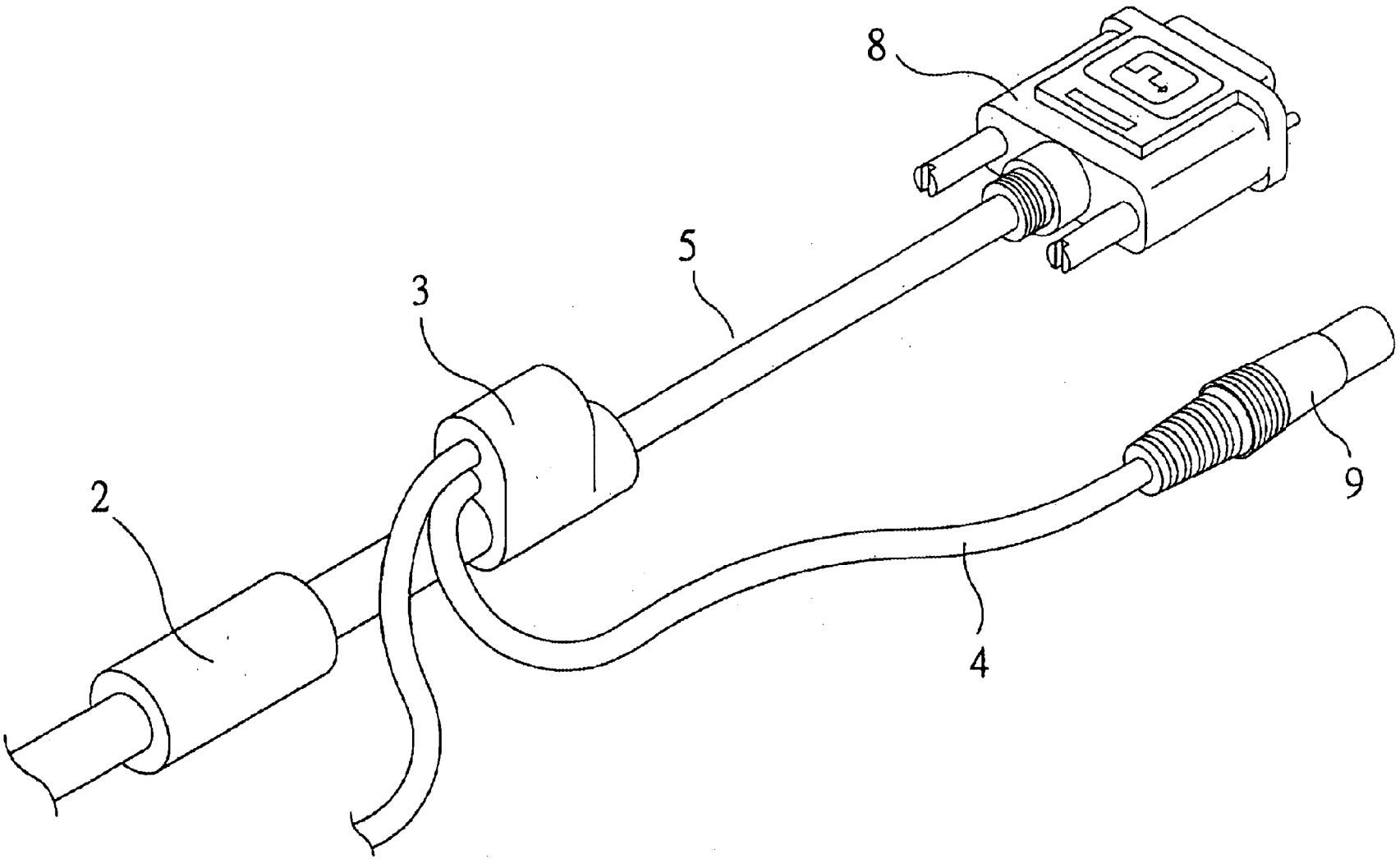
Fig. 2 ( PRIOR ART )
FIG. 2 is a perspective view of a portion of the conventional connecting cable of FIG. 1.

Compared with the prior art of FIG. 1, the connecting cable 10 of FIG. 3 can have a better performance in suppressing the electromagnetic interference of the high-frequency noise. By a practical examination, it is proved that the connecting cable 10 of the present invention can suppress the noise with a frequency higher than 500 MHz. In the present invention, the performance of the connecting cable 10 in suppressing electromagnetic interference is dependent upon the coil number of the coil wire 42. Further in the present invention, the power cable 40 can be wrapped in accordance with a circular pattern, a rectangular pattern, or the like.

Figure 4:
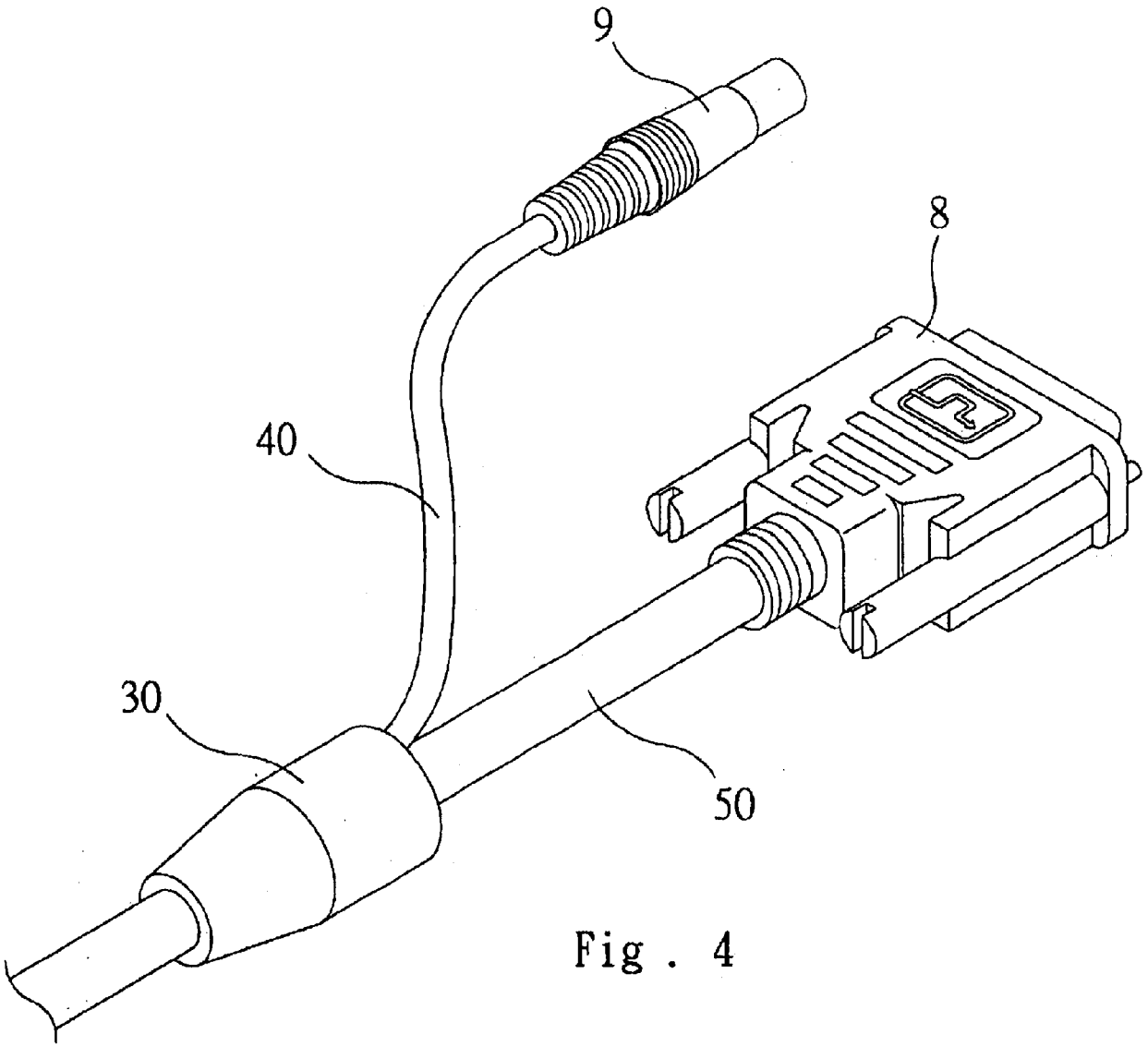
FIG. 4 is a perspective view of a portion of the connecting cable of FIG. 3.
Figure 5:
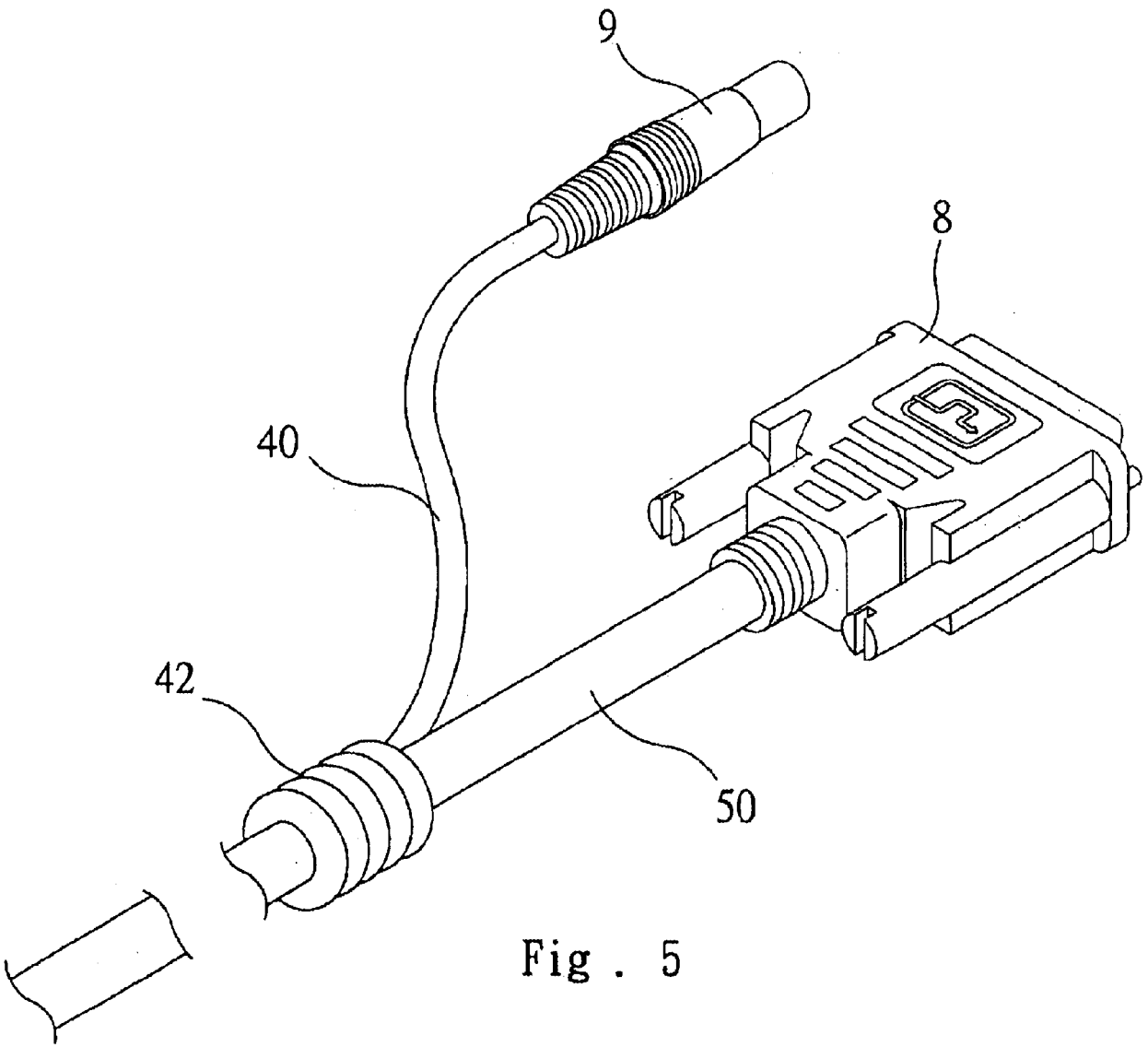
FIG. 5 is a perspective view of the connecting cable of FIG. 4 by removing the splitter.

In FIG. 4, a perspective view upon a portion of the connecting cable 10 of FIG. 3 is present. Also, in FIG. 5, the connecting cable 10 of FIG. 4 is shown by removing the splitter 30 and the fixing annulus 70 to directly illustrate the coil wire 42 inside the splitter 30. Obviously, in the present invention, the coil wire 42 of the power cable 40 is fixed by the splitter 30 and the fixing annulus 70. It is noted from FIG. 3 and FIG. 4 that the LCD cable is used as the preferred embodiment of the present invention. Nevertheless, the coil wiring in accordance with the present invention can be still utilized to other computer peripheral devices such as cable modems, network cards, network devices, image scanners and other peripheral devices for rapid data transmission. By providing the coil wiring of the present invention, the electromagnetic interference can be successfully suppressed.

Furthermore, the present invention has been practically verified to be superior to the prior art. In the verification, a conventional connecting cable using the ferrite core and a connecting cable of the present invention are simultaneously examined to an identical system.

Figure 6:
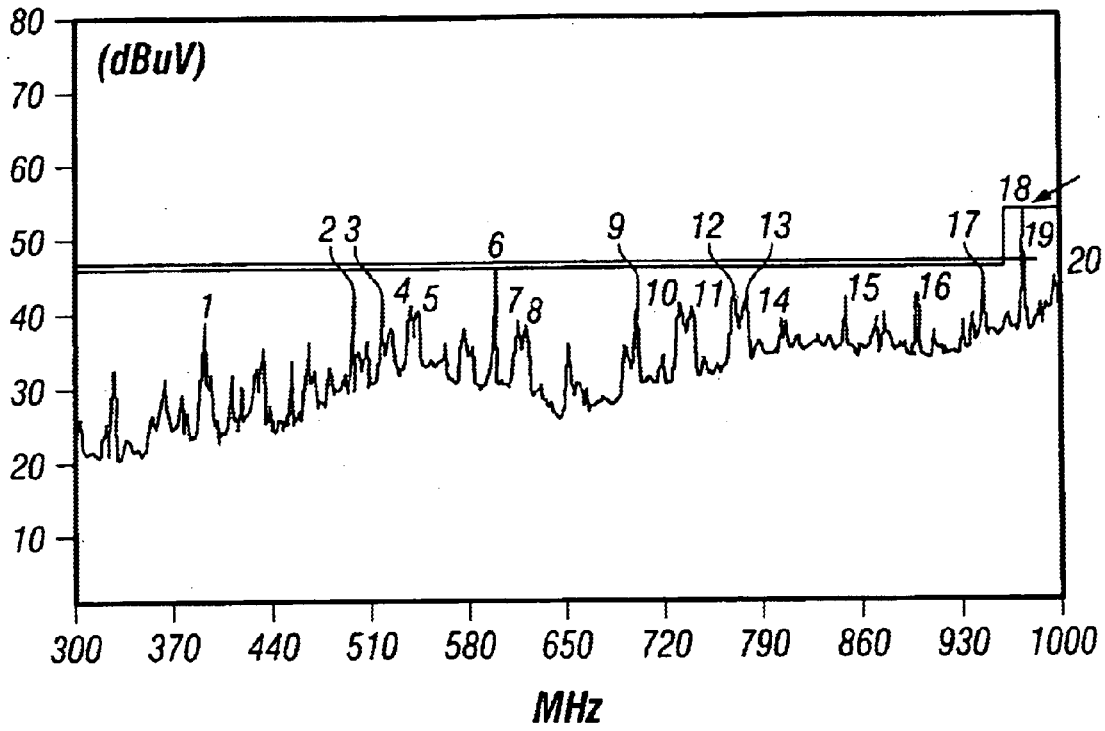
FIG. 6 is an EMI test report scheme of a conventional connecting cable under differently frequency noises.

FIG. 6 is an EMI test report scheme of a conventional connecting cable under differently frequency noises, wherein the data transmission rate is varied from 300 MHz increasing to 1GHz and an antenna with model no. 6112A.2244 is used to receive the EMI signal value presenting by the dBuV unit. FIG. 6 further shows the twenty relatively maximum values and are indicated by number 1 to 20. As shown in FIG. 6, the EMI intensity increases when the data transmission rate increases. It is noted that the number of the relatively maximum EMI value larger than 40 dBuV is sixteen (16) and the maximum EMI value is 54 dBuV when the data transmission rate is 971.52 MHz.

Figure 7:
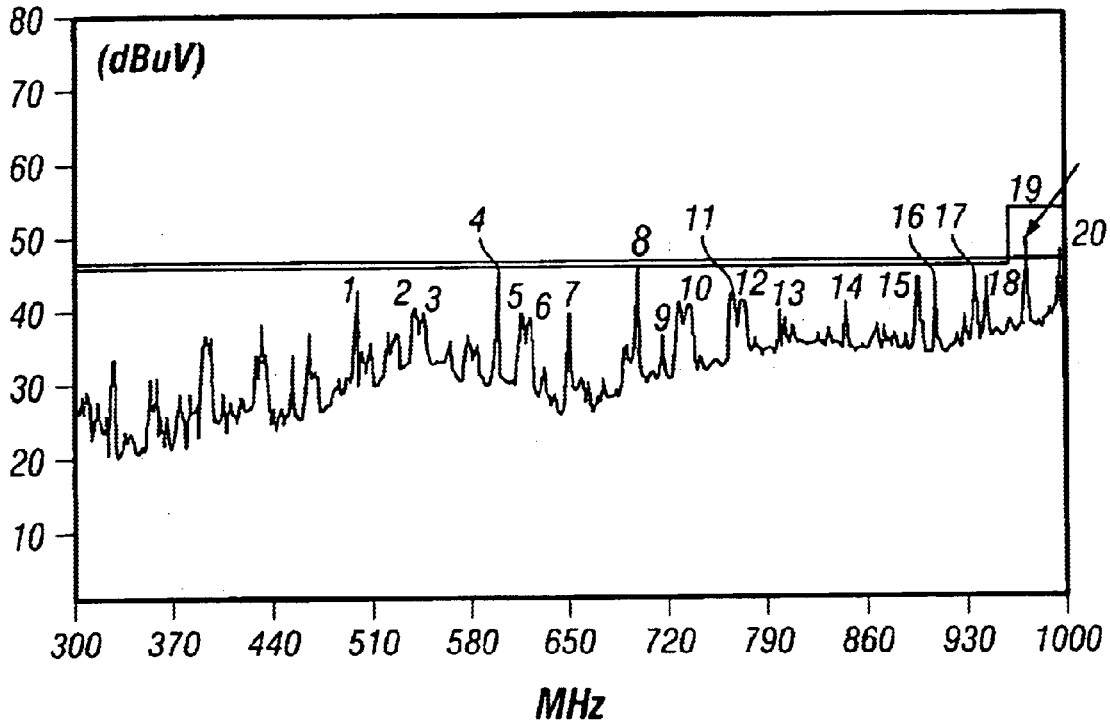
FIG. 7 is an EMI test report scheme of a preferred embodiment of the connecting cable in accordance with the present invention under differently frequency noises.

FIG. 7 is an EMI test report scheme of a preferred embodiment of the connecting cable in accordance with the present invention under differently frequency noises, wherein the data transmission rate is varied from 300 MHz increasing to 1GHZ and an antenna with model no. 6112A.2244 is used to receive the EMI signal value presenting by the dBuV unit. FIG. 7 further shows the twenty relatively maximum values and are indicated by number 1 to 20. As shown in FIG. 7, the EMI intensity increases when the data transmission rate increases. It is noted that the number of the relatively maximum EMI value larger than 40 dBuV is twelve (12) and the maximum EMI value is 49 dBuV when the data transmission rate is 971.52 MHz.

After a careful investigation upon the examination results, it is found that the connecting cable provided by the present invention can have a remarkable improvement in suppressing the electromagnetic interference around the frequency of 971.52 MHz. By providing the coil wire for suppressing electromagnetic interference, advantages at simple structuring, low production cost and a compact volume can be easily obtained, in addition to the major advantage of suppressing electromagnetic interference of high-frequency noises.

While the present invention has been particularly shown and described with reference to a preferred embodiment, it will be understood by those skilled in the art that various changes in form and detail may be without departing from the spirit and scope of the present invention.

What is claimed is:

1. A power cable, comprising a first end adapted to connect to a power plug and a second end adapted to connect to a signal line of a connecting cable, wherein a portion of the power cable comprises a coil wire that wraps the signal line for providing the connecting cable with a performance to suppress electromagnetic interference.

2. The power cable according to claim 1, further comprising a splitter for fixing said coil wire to said signal line.

3. The power cable according to claim 1, further comprising a conductive cloth for covering the second end of said power cable to said signal line.

4. The power cable according to claim 1, wherein said signal line is a high-frequency signal line.

5. The power cable according to claim 1, wherein said power cable is a DC power cable.

6. The power cable according to claim 1, wherein said performance is dependent upon the coil number of said coil wire.

7. The power cable according to claim 1, wherein said performance is to suppress a high-frequency noise with a frequency higher than 500 MHz.

8. The power cable according to claim 1, wherein said coil wire wraps said signal line by a rectangular wiring pattern.

9. An LCD cable for suppressing electromagnetic interference, bridging a computer host and an LCD, including a splitter to bifurcate the LCD cable into two lines, comprising:

a signal line for data transmission, having thereof an end for connection with a peripheral device and another end for connection with a power cable at the splitter and for further connection to the computer host; and a power cable, being a DC power cable, having thereof one end for connection with the signal line at the splitter and another end formed as a DC plug;

wherein the power cable wraps the signal line at the splitter to from a coil wire so as to reduce noise intensity on the power cable, thus, for achieving a performance of suppressing electromagnetic interference.

10. The LCD cable for suppressing electromagnetic interference according to claim 9, further includes a braided wire wrapping said signal line for shielding said signal line from noises.

11. The LCD cable for suppressing electromagnetic interference according to claim 9, further includes a thin wire wrapping said signal line for performing as a ground loop.

12. The LCD cable for suppressing electromagnetic interference according to claim 9, wherein said splitter fixes said coil wire of said power cable to said signal line.

13. The LCD cable for suppressing electromagnetic interference according to claim 9, further includes a conductive cloth for covering a portion of said power cable after coil wiring to said signal line.

14. The LCD cable for suppressing electromagnetic interference according to claim 9, wherein said signal line is a high-frequency signal line and said LCD cable is capable to suppress high-frequency noises.

15. The LCD cable for suppressing electromagnetic interference according to claim 9, wherein said power cable is a DC power cable.

16. The LCD cable for suppressing electromagnetic interference according to claim 9, wherein said performance is dependent upon the coil number of said coil wire.

17. The LCD cable for suppressing electromagnetic interference according to claim 9, wherein said performance is to suppress a high-frequency noise with a frequency higher than 500 MHz.

18. The LCD cable for suppressing electromagnetic interference according to claim 9, wherein said power cable wraps said signal line by a rectangular wiring pattern.

* * * * *